US010767586B2

(12) United States Patent
Lenk et al.

(10) Patent No.: US 10,767,586 B2
(45) Date of Patent: Sep. 8, 2020

(54) PILOT CONTROL OF AN INTERNAL COMBUSTION ENGINE

(71) Applicant: CONTINENTAL AUTOMOTIVE GMBH, Hannover (DE)

(72) Inventors: Jan-Richard Lenk, Regensburg (DE); Sebastian Viehöver, Regensburg (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 15/651,087

(22) Filed: Jul. 17, 2017

(65) Prior Publication Data

US 2017/0314488 A1 Nov. 2, 2017

Related U.S. Application Data

(63) Continuation of application No. PCT/EP2015/077750, filed on Nov. 26, 2015.

(30) Foreign Application Priority Data

Jan. 21, 2015 (DE) ..... 10 2015 200 898

(51) Int. Cl.
*F02D 41/14* (2006.01)
*F02D 41/24* (2006.01)
*F02D 13/02* (2006.01)

(52) U.S. Cl.
CPC ..... *F02D 41/1402* (2013.01); *F02D 41/1454* (2013.01); *F02D 41/2445* (2013.01);
(Continued)

(58) Field of Classification Search
CPC ..... F02D 41/1454; F02D 41/1455; F02D 41/1456; F02D 41/1458; F02D 41/2454;
(Continued)

(56) References Cited

U.S. PATENT DOCUMENTS 4,380,985 A * 4/1983 Otsuka ..... F02D 41/0002 123/690
4,380,988 A * 4/1983 Otsuka ..... F02D 41/0002 123/568.27

(Continued)

FOREIGN PATENT DOCUMENTS

CN 101619682 A 1/2010
DE 102008012607 B4 3/2013

(Continued)

OTHER PUBLICATIONS

English machine translation provided by ESPACENET JP-61066835-A (Year: 2019).*

(Continued)

*Primary Examiner* — Jacob M Amick
*Assistant Examiner* — Michael A Kessler

(57) ABSTRACT

A method, computer program product and apparatus for the pilot control of a mixture preparation for an internal combustion engine are disclosed, which include determining a configuration of the internal combustion engine. The configuration is determined by a combination of discrete positions of a plurality of actuators which influence at least one operating parameter of the internal combustion engine. The method, computer program product and apparatus additionally determine a constant adaptation component of the mixture preparation which is fed back by an exhaust gas probe of the internal combustion engine, and store the constant adaptation component and the associated configuration in memory. The pilot control of the mixture preparation is performed with the constant adaptation component when the internal combustion engine is operated in the same configuration.

17 Claims, 3 Drawing Sheets

(52) U.S. Cl.
CPC ..... *F02D 41/2454* (2013.01); *F02D 41/2461* (2013.01); *F02D 41/2464* (2013.01); *F02D 13/0207* (2013.01); *F02D 13/0219* (2013.01); *F02D 2041/141* (2013.01)

(58) Field of Classification Search
CPC ..... F02D 41/2461; F02D 41/2464; F02D 41/2445; F02D 41/2441; F02D 41/1402; F02D 41/2467; F02D 41/247; F02D 41/3076; F02D 41/2448; F02D 2041/141; F02D 2041/389; F02D 2041/3094; F02D 2041/1427; F02D 2041/142; F02D 2200/023; F02D 2200/0414; F02D 2200/0802; Y02T 10/47; Y02T 10/26; F01N 2430/06; F01N 2900/0402; F01N 2560/025
USPC ..... 123/674, 679, 680, 681, 683, 685, 686; 60/276, 285, 286; 701/103, 109
See application file for complete search history.

(56) References Cited

U.S. PATENT DOCUMENTS

| | | | | | |
|---|---|---|---|---|---|
| 4,383,409 | A * | 5/1983 | Otsuka | F02D 41/1474 | 123/479 |
| 4,392,471 | A * | 7/1983 | Miyagi | F02D 41/182 | 123/683 |
| 4,440,131 | A * | 4/1984 | Felger | F02D 41/1487 | 123/445 |
| 4,441,473 | A * | 4/1984 | Isomura | F02D 41/2493 | 123/674 |
| 4,450,680 | A * | 5/1984 | Otsuka | F02D 35/0023 | 60/274 |
| 4,501,242 | A | 2/1985 | Niimi et al. | | |
| 4,557,242 | A * | 12/1985 | Hasegawa | F01N 3/22 | 123/681 |
| 4,571,683 | A | 2/1986 | Kobayashi et al. | | |
| 4,584,982 | A * | 4/1986 | Clement | F02D 41/2454 | 123/680 |
| 4,744,344 | A | 5/1988 | Morozumi | | |
| 4,825,837 | A | 5/1989 | Nakagawa | | |
| 6,116,227 | A * | 9/2000 | Yoshioka | F02D 41/2461 | 123/674 |
| 2004/0186654 | A1* | 9/2004 | Lederer | F02D 41/2422 | 701/109 |
| 2004/0210379 | A1* | 10/2004 | Kirschke | F02D 41/22 | 701/114 |
| 2007/0125350 | A1 | 6/2007 | Morita et al. | | |
| 2007/0199552 | A1* | 8/2007 | Furukawa | F02D 41/149 | 123/674 |
| 2007/0199553 | A1* | 8/2007 | Thiel | F02D 41/1402 | 123/690 |
| 2009/0266052 | A1 | 10/2009 | Rajagopalan et al. | | |
| 2010/0024790 | A1 | 2/2010 | Fujiwara et al. | | |

FOREIGN PATENT DOCUMENTS

| | | | | | |
|---|---|---|---|---|---|
| EP | 1132600 | A2 | | 9/2001 | |
| JP | S60169659 | U | | 9/1985 | |
| JP | S6143237 | A | | 3/1986 | |
| JP | 61066835 | A | * | 4/1986 | F02D 41/2454 |
| JP | H01203635 | A | | 8/1989 | |
| JP | 2004132314 | A | | 4/2004 | |
| JP | 2014092062 | A | | 5/2014 | |
| KR | 20150132027 | | | 11/2015 | |

OTHER PUBLICATIONS

International Search Report and Written Opinion dated Mar. 4, 2016 from counterpart International Patent Application No. PCT/EP2015/077750.
English Translation of JP2014092062A (Translated by Thomson Reuters).
Korean Office Action dated May 31, 2018 for corresponding Korean application No. 10-2017-7020288.
Korean Notice of Allowance dated Nov. 19, 2018 for corresponding Korean application No. 10-2017-7020288.
Chinese First Office Action dated Jul. 25, 2019 for the counterpart Chinese Patent Application No. 201580072438.1.
Chinese Second Office Action dated Apr. 20, 2020 for the counterpart Chinese Patent Application No. 201580074238.1.

* cited by examiner

PILOT CONTROL OF AN INTERNAL COMBUSTION ENGINE

CROSS REFERENCE TO RELATED APPLICATIONS

This application claims the benefit of PCT Application PCT/EP2015/077750 filed Nov. 26, 2015, which claims priority to German Application DE 10 2015 200 898.3, filed Jan. 21, 2015. The contents of the above applications are incorporated herein by reference.

FIELD OF INVENTION

The invention relates to the mixture preparation of an internal combustion engine. In particular, the invention relates to the mixture preparation in pilot control mode.

BACKGROUND

An internal combustion engine, in particular a reciprocating-piston internal combustion engine, for example on board a motor vehicle, is operated by means of a mixture preparation, wherein the mixture preparation determines a quantity or mass of fuel which is to be injected into the internal combustion engine on the basis of parameters which influence the operation of the internal combustion engine. In addition, the mixture preparation evaluates the signal from a λ probe which is arranged in the exhaust tract of the internal combustion engine and indicates whether the combustion is proceeding in a stoichiometric manner, that is to say neither with excess fuel nor with excess air.

In order to be able to always adapt the internal combustion engine to an extremely wide variety of operating points in an improved manner, operating parameters can increasingly be changed by means of actuators. For example, control times of an inlet valve or an outlet valve, compression of a piston, a proportion of returned exhaust gas can be varied. In addition, there is a further degree of freedom in the case of a so-called dual injection system comprising a combination of intake manifold and direct injection operation. The mixture preparation takes into account the positions of the actuators when determining the quantity of fuel. Remaining deviations which can be attributed, for example, to imperfections of an actuator are corrected on the basis of the λ value.

The λ probe requires a high operating temperature which is usually not yet reached immediately after the internal combustion engine is started. During this phase, the mixture preparation has to carry out a pilot control operation, that is to say determine the quantity of fuel to be injected on the basis of operating parameters of the internal combustion engine, without receiving feedback about the quality of the combustion.

DE 10 2008 012 607 B4 proposes carrying out the pilot control of the mixture preparation on the basis of the main parameters rotation speed, load and temperature. Here, a fixed dependence of the quantity of fuel to be injected on the main parameters is assumed.

However, the actuators are subject to inaccuracies which can have a significant influence on the pilot control. For example, the actual position of an actuator may differ from its intended position owing to wear, scatter or temperature influence. In this case, pilot control can be carried out on the basis of main parameters of the internal combustion engine only with difficulty. The combustion result may be of low quality, with the result that the environmental pollution created by the internal combustion engine increases.

SUMMARY

An object of embodiments of the present invention is to specify an improved technique for mixture preparation during the pilot control of an internal combustion engine.

A method for the pilot control of a mixture preparation for an internal combustion engine includes the steps of determining a configuration of the internal combustion engine, wherein the configuration is realized by means of a combination of discrete positions of a plurality of actuators which influence operating parameters of the internal combustion engine, determining a constant adaptation component of the mixture preparation which is fed back by means of an exhaust gas probe of the internal combustion engine, storing the constant adaptation component and the associated configuration, and performing pilot control of the mixture preparation with the constant adaptation component when the internal combustion engine is operated in the same configuration.

Using the information from the λ probe, the mixture preparation controls the quantity of fuel to be injected during conventional operation in such a way that all inaccuracies and deviations of actual positions of the actuators from their intended values are suitably compensated. Deviations of this kind are incorporated into a constant adaptation component. In this case, the adaptation corresponds to the deviation between the injection quantity determined on the basis of the operating parameters and the actual injection quantity determined on the basis of the λ signal. A variable adaptation component can be attributed to measurement delays, measurement noise and other influences. In the present case, the constant component is assumed to be a deviation in at least one of the actuators from its intended position. By virtue of storing the constant adaptation component during feedback of the mixture preparation by means of the exhaust gas probe, the pilot control can be adapted to the faults in the actuators in an improved manner at a different time at which the internal combustion engine is operated in the same configuration. In addition, improved operation of the internal combustion engine may be achieved when the exhaust gas probe is not available, for example during a cold-running phase of the internal combustion engine.

The combination of the discrete positions of the actuators may be understood to be a logical engine. If the position of only one of the actuators changes, another logical engine for which another constant adaptation component may apply is created. This procedure is advantageous particularly in case of conventional actuators which have only a small number of two or three different positions.

A direct relationship may be established between a mixture deviation or a mixture adaptation and the actuators involved in the deviation.

A temperature dependence of an actuator or a drive strategy may already be taken into account by the concept of the logical engine. If, for example, there is a drive strategy according to which a piston stroke is changed over from a discrete value to another value when a predetermined oil or coolant temperature is reached, two logical engines are automatically formed, one of which operates at the relatively low temperature and the other of which operates at the relatively high temperature. A further operation taking into account the temperature may then no longer be required.

An actuator adaptation which can adapt the drive strategy by means of the aging of a control element may automatically also influence the position of the mixture adaptation range by means of the design of the logical engines.

Different actuator combinations at the same engine operating point (for example with respect to a rotation speed, a load and/or a temperature) may also have different adaptation values over the logical engines.

In an embodiment, an associated constant adaptation component is used for each combination of discrete positions of the actuators. Therefore, the pilot control may be operated with all discrete position combinations. The internal combustion engine may therefore be operated in the warm-running phase on the part of the mixture preparation in all position combinations of the actuators.

In an embodiment, the pilot control operation takes into account the constant adaptation component in an additive manner. This is often expedient particularly in the case of low loading of the internal combustion engine. In another embodiment, the pilot control operation may also take into account the constant adaptation component in a multiplicative manner. This may provide better results particularly in the case of a higher load on the internal combustion engine.

In a yet further embodiment, the mixture preparation is performed depending on at least one of the parameters of the internal combustion engine, wherein the way in which the constant adaptation component is taken into account during the pilot control operation is dependent on this parameter. In particular, the loading of the internal combustion engine may be expressed, for example, by a rotation speed or a torque, wherein the constant adaptation component is taken into account in an additive manner in the case of a low rotation speed or low torque and is taken into account in a multiplicative manner in the case of a high rotation speed or a high torque.

In an embodiment, the mixture preparation is performed depending on a plurality of parameters of the internal combustion engine, wherein respectively associated constant adaptation components are used for different ratios of these parameters. The phase space of the operating states of the internal combustion engine in a combination of discrete positions of the actuators may therefore be suitably broken up in order to allow more precise handling in subspaces. This division may advantageously be assisted by the management of a correspondingly large number of constant adaptation components.

A computer program product includes program code means for carrying out the above-described method when the computer program product runs on a processing device or is stored in a computer-readable data carrier.

An apparatus for the pilot control of a mixture preparation for an internal combustion engine includes a first interface for sampling a configuration of the internal combustion engine, a second interface for sampling a constant adaptation component of a mixture preparation which is fed back by means of an exhaust gas probe of the internal combustion engine, a memory for recording the constant adaptation component and the associated configuration, and a processing device for providing the constant adaptation component to the mixture preparation when the internal combustion engine is operated in the same configuration and the exhaust gas probe is not available. In this case, the configurations are realized by means of a combination of discrete positions of a plurality of actuators which influence operating parameters of the internal combustion engine.

BRIEF DESCRIPTION OF THE DRAWINGS

The embodiments of the invention will now be described in more detail with reference to the appended figures, in which.

DETAILED DESCRIPTION

Figure 1:
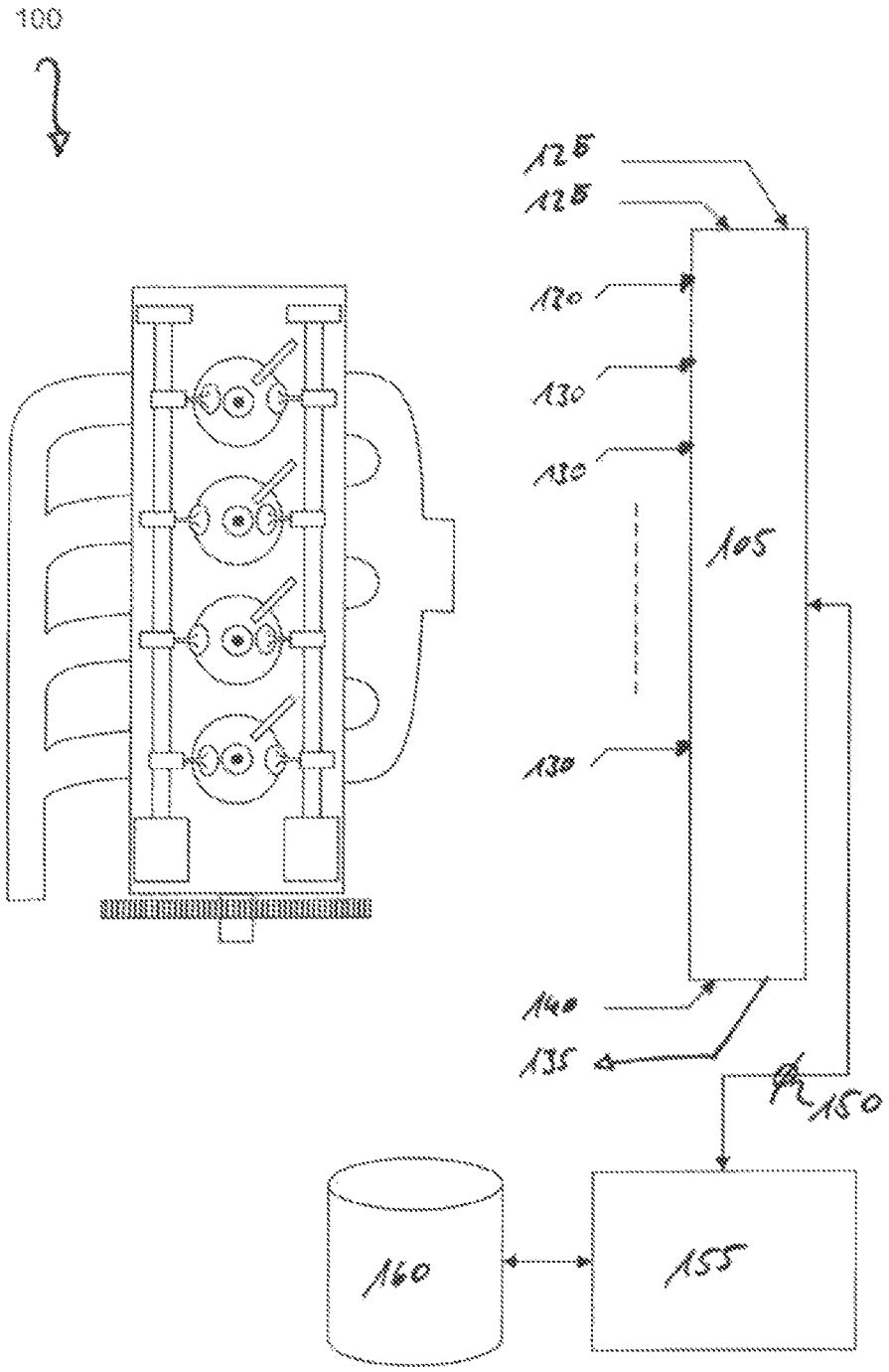
FIG. 1 shows an internal combustion engine with a mixture preparation.

FIG. 1 shows an internal combustion engine 100 with a mixture preparation 105. The internal combustion engine 100 may be designed, in particular, for operation in a motor vehicle. The internal combustion engine 100 may include a multi-cylinder reciprocating-piston engine. The mixture preparation 105 is connected to a number of sensors 125 and actuators 130. The mixture preparation 105 determines the quantity of fuel which should be injected into the internal combustion engine 100 for combustion. In one embodiment, the mixture preparation 105 is designed to drive a fuel injector 135 for dispensing the determined quantity of fuel. The quantity of fuel is usually determined with respect to one or more parameters which may be tapped off from the internal combustion engine 100. For example, one of the sensors 125 may be an airflow meter, a rotation speed sensor or a torque sensor. Further sensors are likewise possible and may determine, for example, different temperatures or pressures in the internal combustion engine 100.

The operation of the internal combustion engine 100 may additionally be influenced by means of at least one actuator 130, wherein the actuator 130 has a fixedly predetermined number of discrete positions. A plurality of actuators 130 are usually provided, the actuators controlling, for example, a stroke or a phase of an inlet valve, a stroke or a phase of an outlet valve, a compression of a cylinder or the use of one or more possible injectors.

The mixture preparation 105 is connected to a processing device 155 by means of an interface 150, the processing device in turn being connected to a memory 160. The processing device 155 is configured to determine, during conventional operation in which a λ probe 140 is available, a deviation between a quantity of fuel which is determined on the basis of the sensors 125 and positions of the actuators 130, and the quantity of fuel which is determined on the basis of the signal from the λ probe 140. In particular, a constant proportion is determined and stored in the memory 160 from this difference. This value is associated with a configuration of the internal combustion engine 100, which configuration is dependent on assumed discrete positions of the actuators 130 owing to the combination. In other words, a pair of values may be formed, which pair of values comprises the combination and the constant adaptation component used. In another embodiment, a fixed location in the memory 160 is associated with one combination and the determined constant adaptation component is stored at the associated point.

If the internal combustion engine 100 is operated at a later time without the λ probe 140 being available, for example because it does not yet output a useful signal during a warm-running phase of the internal combustion engine 100, the mixture preparation 105 has to control the internal combustion engine 100 or determine the quantity of fuel to be injected in the pilot control mode, that is to say without feedback by the signal of the λ probe 140. To this end, it is proposed to obtain, via the interface 150, that constant adaptation component which corresponds to the current configuration of the internal combustion engine 100 from the memory 160 using the processing device 155. This adaptation component is then used to correct the quantity of fuel which was determined on the basis of the positions of the actuators 130 and the signal values from the sensors 125.

A direct relationship between the mixture adaptation and the actuators 130 which are involved in the deviation may be expressed by the constant adaptation component. Temperature dependences of an actuator 130 and of the drive strategy of the actuator 130 may be automatically taken into account since the drive strategy is reflected in the configuration of the internal combustion engine 100. If, for example, a piston stroke of the internal combustion engine 100 is first changed over at a predetermined operating temperature, this changeover is also automatically taken into account in the pilot control mode by the proposed procedure. Adaptations to the actuators 130 which can adapt the drive strategy, for example by means of influences such as aging of an actuator 130, may automatically also influence the position of the mixture adaptation range. Different configurations of the internal combustion engine 100 at the same operating point in respect of rotation speed, load and temperature of the internal combustion engine 100 may also have different adaptation values in this way.

Figure 2:
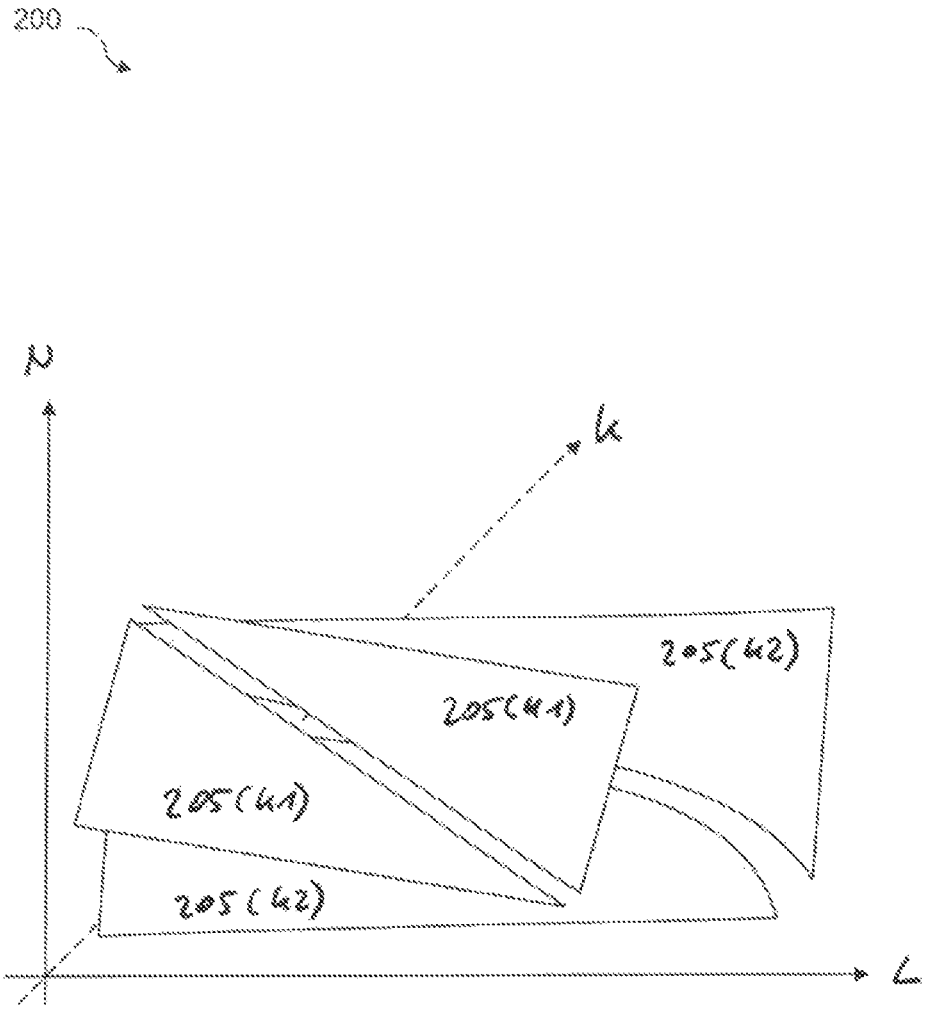
FIG. 2 shows phase spaces of the mixture preparation of FIGS. 1.

FIG. 2 shows phase spaces 200 of the mixture preparation 105 of FIG. 1. A load L of the internal combustion engine 100 is plotted in the horizontal direction, and the rotation speed N of said internal combustion engine is plotted in the vertical direction. Different configurations K of the internal combustion engine 100 are indicated along a third axis.

At least one constant adaptation component, which is used for determining the quantity of fuel to be injected, is prespecified for each configuration K. In the illustration of FIG. 2, two adaptation values, which cover different parts of the respective phase space, are prespecified for each configuration K. Purely by way of example, the phase spaces are separated into subspaces 205 which have a substantially triangular shape.

The associated constant adaptation components may be taken into account in an additive manner or in a multiplicative manner in different embodiments. In one embodiment, the way in which the adaptation components are taken into account may be dependent on the load of the internal combustion engine 100. In this case, the transfer may be made in discrete steps or continuously. For example, the stored constant adaptation component may be taken into account in an additive manner in the case of a low load, while the adaptation component is taken into account in a multiplicative manner in the case of a higher load. For a continuous transfer, the processes of taking into account the adaptation component both in an additive manner and in a multiplicative manner are determined and weighted by means of weighting factors which are dependent on the load. The sum of the weighted correction terms is then passed on to the processing device 105.

As in the case of a known mixture adaptation, the correction of the fuel pilot control may be taken into account directly during calculation of the quantity of fuel to be injected. However, ascertaining the correction value to be taken into account depends, amongst other things, on the currently active logical engine:

$$MFF_SP_COR=MFF_SP_BAS*[\Sigma(AD_i_LogEng_k\times FAC_i_k)]/\Sigma(FAC_i_k)]*FAC_LAM* \ldots$$

where:

MFF_SP_COR: actuating value for fuel flow, which actuating value is corrected by exhaust gas control MFF_SP_BAS: actuating value for basic fuel flow LogEng_k: logical engine k AD_i_LogEng_k: adaptation value i of the logical engine k FAC_i_k: weighting factor for adaptation value i of the logical engine k FAC_LAM: correction of the lambda pilot control and/or lambda control.

When a changeover is made between actuator positions, the transition between two related adaptation values is also defined by means of the weighting factors FAC_i_k. This transition represents the physical transition in this case. A transition may therefore be performed in a synchronized manner at the moment at which, for example, a valve stroke is changed in order to apply the correct adaptation value in good time for the purpose of calculating the associated injection mass. Furthermore, a transition may, however, also be performed with a time delay or in the form of a smoothed transfer.

Figure 3:
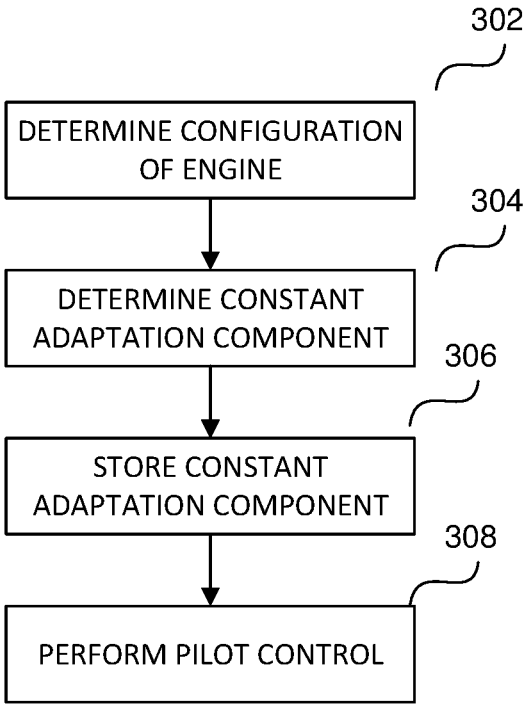
FIG. 3 is a flowchart of the operation of an example embodiment.

Referring to FIG. 3, there is shown a method for the pilot control of a mixture preparation for an internal combustion engine includes the steps of determining at 302 a configuration of the internal combustion engine, wherein the configuration is realized by means of a combination of discrete positions of a plurality of actuators which influence operating parameters of the internal combustion engine, determining at 304 a constant adaptation component of the mixture preparation which is fed back by means of an exhaust gas probe of the internal combustion engine, storing at 306 the constant adaptation component and the associated configuration, and performing at 308 pilot control of the mixture preparation with the constant adaptation component when the internal combustion engine is operated in the same configuration.

Embodiments have been described herein in an illustrative manner, and it is to be understood that the terminology which has been used is intended to be in the nature of words of description rather than of limitation. Obviously, many modifications and variations of the invention are possible in light of the above teachings. The description above is merely exemplary in nature and, thus, variations may be made thereto without departing from the spirit and scope of the invention as defined in the appended claims.

LIST OF REFERENCE SYMBOLS

100 Internal combustion engine
105 Mixture preparation
110 Processing device
125 Sensor
130 Actuator
135 Fuel injector
140 Lambda probe
150 Interface
155 Processing device
160 Memory
200 Phase space
205 Subspace
L Load
N Rotation speed
K Configurations

We claim:

1. A method for the pilot control of a mixture preparation for an internal combustion engine, wherein the method comprises:

determining a configuration of the internal combustion engine, wherein the configuration is realized by a combination of discrete positions of a plurality of actuators which influence at least one operating parameter of the internal combustion engine;

determining a constant adaptation component of the mixture preparation which is fed back by an exhaust gas probe of the internal combustion engine;

storing the constant adaptation component and the associated configuration; and performing pilot control of the mixture preparation with the constant adaptation component when the internal combustion engine is operated in the same configuration, the pilot control being performed without receiving feedback from the exhaust gas probe, wherein the pilot control performed takes into account the constant adaptation component in an additive manner, with a first load of the internal combustion engine and in a multiplicative manner, different from the additive manner, with a second load of the internal combustion engine, wherein the first load is less than the second load.

2. The method as claimed in claim 1, wherein a plurality of configurations with associated constant adaptation components are used during the pilot control.

3. The method as claimed in claim 2, wherein an associated constant adaptation component is used for each combination of discrete positions of the actuators.

4. The method as claimed in claim 1, wherein the mixture preparation relates to a quantity of fuel to be injected into a combustion chamber of the internal combustion engine.

5. The method as claimed in claim 1, wherein the mixture preparation is performed depending on at least one operating parameter of the internal combustion engine, and a way in which the constant adaptation component is taken into account during the pilot control operation is dependent on the at least one operating parameter.

6. The method as claimed in claim 5, wherein the mixture preparation is performed depending on a plurality of operating parameters of the internal combustion engine and respectively associated constant adaptation components are used for different ratios of the plurality of operating parameters.

7. A computer program product for pilot control of a mixture preparation for an internal combustion engine, the computer program product stored in non-transitory memory such that when executed by a processing device, the computer program product causes the processing device to:

determine a configuration of the internal combustion engine, wherein the configuration is realized by a combination of discrete positions of a plurality of actuators which influence operating parameters of the internal combustion engine;

determine a constant adaptation component of the mixture preparation which is fed back by an exhaust gas probe of the internal combustion engine;

store, in the non-transitory memory, the constant adaptation component and the associated configuration; and perform pilot control of the mixture preparation with the constant adaptation component when the internal combustion engine is operated in the same configuration, the pilot control being performed without receiving feedback from the exhaust gas probe, wherein the pilot control takes into account the constant adaptation component in an additive manner with a first load of the internal combustion engine and in a multiplicative manner, different from the additive manner, with a second load of the internal combustion engine, wherein the first load is less than the second load.

8. The computer program product of claim 7, wherein the computer program product determines a constant adaptation component of the mixture preparation for each of a plurality of configurations of the internal combustion engine.

9. The computer program product of claim 7, wherein an associated constant adaptation component is used for each combination of discrete positions of the actuators.

10. The computer program product of claim 7, wherein the mixture preparation relates to a quantity of fuel to be injected into a combustion chamber of the internal combustion engine.

11. The computer program product of claim 7, wherein the mixture preparation is performed depending on at least one operating parameter of the internal combustion engine, and a way in which the constant adaptation component is taken into account during the pilot control operation is dependent on the at least one operating parameter.

12. The computer program product of claim 7, wherein the mixture preparation is performed depending on the operating parameters of the internal combustion engine and respectively associated constant adaptation components are used for different ratios of the plurality of parameters.

13. An apparatus for the pilot control of a mixture preparation for an internal combustion engine, wherein the apparatus comprises:

a first interface configured to sample a configuration of the internal combustion engine, wherein the configuration is realized by a combination of discrete positions of a plurality of actuators which influence operating parameters of the internal combustion engine;

the first interface is also configured to sample a constant adaptation component of a mixture preparation which is fed back by an exhaust gas probe of the internal combustion engine;

a memory configured to record the constant adaptation component and the associated configuration; and a processing device, coupled to the memory, configured to provide the constant adaptation component to the mixture preparation during the pilot control and when the internal combustion engine is operated in the same configuration, wherein the processing device is configured, during the pilot control, to take into account the constant adaptation component in an additive manner and in a multiplicative manner, the additive manner and the multiplicative manner being weighted that is dependent upon a load of the internal combustion engine, the pilot control being performed without receiving feedback from the exhaust gas probe.

14. The apparatus of claim 13, wherein the mixture preparation is performed depending on at least one operating parameter of the internal combustion engine, and a way in which the constant adaptation component is taken into account during the pilot control operation is dependent on the at least one operating parameter.

15. The method as claimed in claim 1, wherein the first load is less than the second load.

16. The computer program product of claim 7, wherein the first load is less than the second load.

17. The apparatus of claim 13, wherein the processing device takes into account the constant adaptation component in an additive manner with a first load and in a multiplicative manner with a second load, the second load being greater than the first load.

* * * * *